United States Patent [19]

Lisiecki

[11] Patent Number: 4,546,915

[45] Date of Patent: Oct. 15, 1985

[54] IN-FOLDED FIN SEAL END CLOSURE

[75] Inventor: Robert E. Lisiecki, Farmington Hills, Mich.

[73] Assignee: Ex-Cell-O Corporation, Troy, Mich.

[21] Appl. No.: 720,314

[22] Filed: Apr. 5, 1985

[51] Int. Cl.[4] ..... B65D 5/72

[52] U.S. Cl. ..... 229/17 G

[58] Field of Search ..... 229/179, 17 R, 7 R

[56] References Cited

U.S. PATENT DOCUMENTS

| | | | |
|---|---|---|---|
| 3,319,868 | 5/1967 | Huang et al. | 229/17 G |
| 3,355,083 | 11/1907 | Wilcox | 229/17 G |
| 3,498,815 | 3/1970 | Bichaylo et al. | 229/17 G |
| 3,825,168 | 7/1974 | Mac Ewen | 229/17 G |
| 4,313,553 | 2/1982 | Lisizeki | 229/17 G |

*Primary Examiner*—Joseph Man-Fu Moy

*Attorney, Agent, or Firm*—John P. Moran

[57] ABSTRACT

There is disclosed a flat end closure arrangement for a thermoplastic coated paperboard container, and the blank therefor, wherein four sets of supplementary score lines are formed on two sides of the resultant end closure, such that they are adapted to be folded into position just inside the usual horizontal score lines separating the end closure panels from the sidewall panels. These supplementary score lines provide a second, substantially 90° bend for the paperboard layers, supplementing a substantially 90° bend about the respective horizontal score lines, in lieu of each usual 180° bend about the respective horizontal score lines, thereby diminishing the chances for cracking of the thermoplastic coating at the bend locations.

5 Claims, 15 Drawing Figures

IN-FOLDED FIN SEAL END CLOSURE

TECHNICAL FIELD

This invention relates generally to liquid-carrying, thermoplastic coated paperboard cartons and, more particularly, to a flat end closure therefor.

BACKGROUND ART

Heretofore, thermoplastic coated paperboard cartons having flat end closures of the in-folded and/or out-folded fin sealed types have been used with generally satisfactory results. When the, so-called, in-folded type of end closure is used, several panel thickness are operative in the folding operations. The multiple panel thicknesses, when folded, cause causing stretching or tensioning of the outer layers around the inner layers to the extent that the outermost thermoplastic layers may tend to pull apart and crack, thereby destroying the liquid impermeable thermoplastic layer, permitting leaking therethrough.

Two known approaches involving supplemental score lines to solve such a cracking problem are shown in Holmstrom U.S. Pat. No. 4,267,957 and in Lisiecki U.S. patent application Ser. No. 634,718.

DISCLOSURE OF THE INVENTION

A general object of the invention is to provide an improved in-folded fin sealed type of end closure for a thermoplastic coated paperboard carton, with provisions for retarding inherent characteristics tending to cause cracking of the thermoplastic coating during the forming operations.

Another object of the invention is to provide an improved in-folded fin sealed type of end closure for a thermoplastic coated paperboard carton, including supplementary score lines for facilitating folding without causing tensioning and cracking of the outer edges of the various layers during the folding process.

A further object of the invention is to provide an in-folded fin sealed type of end closure for a thermoplastic coated paperboard carton, including supplementary score lines which serve to convert 180° end closure bends into two substantially 90° bends, to thereby minimize stretching or tensioning at the 180° bend and resultant cracking of the thermoplastic coating.

Still another object of the invention is to provide an in-folded fin sealed type of end closure for a thermoplastic coated paperboard carton, including supplementary score lines adapted to fold into position just inside the usual horizontal score lines separating the end closure panels from the sidewall panels, and thereby provide a second bend for the paperboard layers in lieu of each usual 180° bend about the horizontal score lines, and thus diminish the chances for cracking of the thermoplastic coating at the bend locations.

A still further object of the invention is to provide an improved in-folded fin sealed type of end closure for a thermoplastic coated paperboard carton, including supplementary score lines which serve to convert 180° end closure bends into two substantially 90° bends, to thereby provide four corner stability for the upright carton.

These and other objects and advantages of the invention will be more apparent when reference is made to the following drawings and the accompanying description.

BEST MODE OF CARRYING OUT THE INVENTION

Figure 1:
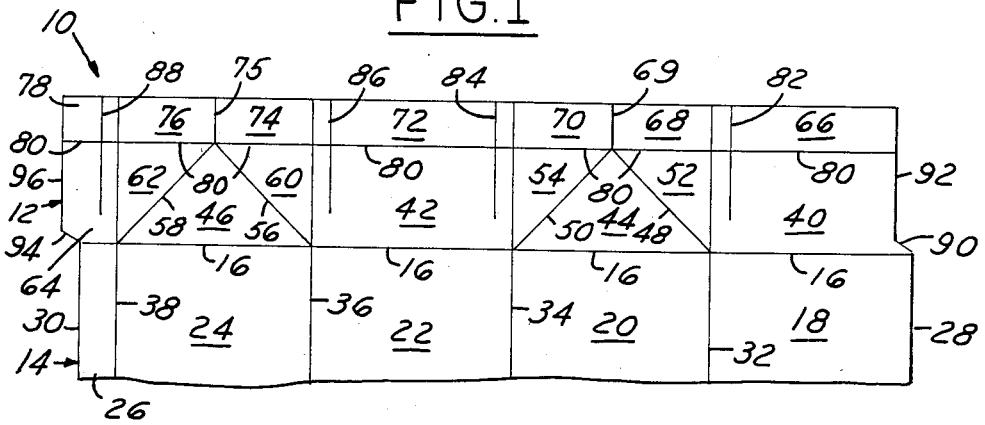
FIG. 1 is a fragmentary layout view of the outside surface of a thermoplastic coated paperboard container blank used to construct a container having an end closure in accordance with the present invention.

Referring now to the drawings in greater detail, FIG. 1 illustrates a fragmentary container blank 10 formed in accordance with the principles of the present invention. The container blank 10 is generally divided into three sections including a first end closure 12, a body portion 14, and a second end closure (not shown). A horizontal score line 16 extends transversely across the container blank 10 and separates the end closure 12 and the body portion 14. The body portion 14 comprises a plurality of integrally connected body panels, namely, a first panel 18, a second panel 20, a third panel 22 and a fourth panel 24, and a side seam flap or narrow fifth panel 26 formed adjacent the fourth panel 24. The container blank 10 is defined on its longitudinal sides by its free edges 28 and 30. The body panels 18, 20, 22 and 24, and the side seam flap 26, are defined by vertical score lines 32, 34, 36 and 38.

The end closure 12 has a pair of inner closure panels 40 and 42 which are integral with and extend longitudinally from the body panels 18 and 22, respectively. A pair of triangular closure panels 44 and 46 are an integral part of the end closure 12, and they extend longitudinally from the body panels 20 and 24, respectively. The triangular closure panel 44 is defined by the transverse score line 16 and diagonal score lines 48 and 50. The triangular closure panel 44 is integrally connected to the inner closure panels 40 and 42 by a pair of triangular panels 52 and 54, respectively. The triangular closure panel 46 is defined by the horizontal score line 16 and a pair of diagonal score lines 56 and 58. A pair of triangular panels 60 and 62 integrally connect the triangular closure panel 46 to the inner closure panel 42 and an extension panel 64 of the side seam flap 26, respectively. As is set forth in more detail hereinafter, the side seam flap 26 is connected to the inner closure panel 40 so as to place the triangular panel 62 adjacent the closure panel 40 in a constructed or erected container. Sealing panels 66, 68, 70, 72, 74, 76 and 78 are connected at a horizontal score line 80 extending transversely across the blank 10 to the panels 40, 52, 54, 42, 60, 62 and 64, respectively. A score line 69 separates the panels 68 and 70, and a score line 75 separates the panels 74 and 76.

Two supplemental score lines 82 and 84 are formed adjacent opposite sides of the closure panels located intermediate the vertical score lines 32 and 34, respectively. Specifically, the score line 82 is formed across the sealing panel 66, and partially across the inner closure panel 40, adjacent and parallel to the score line 32. The score line 84 is formed across the sealing panel 72, and partially across the inner closure panel 42, adjacent and parallel to the score line 34, and is the mirror image of the score line 82.

Two more supplemental score lines 86 and 88 are formed adjacent opposite sides of the closure panels located intermediate the vertical score lines 36 and 38, respectively. The set 86 and 88 is identical to the set 82 and 84, but with respect to the vertical score lines 36 and 38. Specifically the score line 86 is formed across the sealing panel 72, and partially across the inner closure panel 42, adjacent and parallel to the score line 36. The score line 88 is formed across the sealing panel 78, and partially across the extension panel 64, adjacent and parallel to the score line 38.

The free edge 28 is terminated by an inwardly directed diagonal edge 90 extending from the score line 16, to a vertical edge 92. The edge 92 is adapted to align with the score line 88 in the folding operation to follow, and the cutting of the edges 90 and 92 serves to form a stepped tab on the adjacent blank (not shown) like that defined by the edges 94 and 96 on the extension panel 64 of the side seam flap 26.

The details of typical second end closure arrangements are discussed in detail in U.S. Pat. Nos. 3,498,524; 3,120,335 and 4,341,340.

Figure 2:
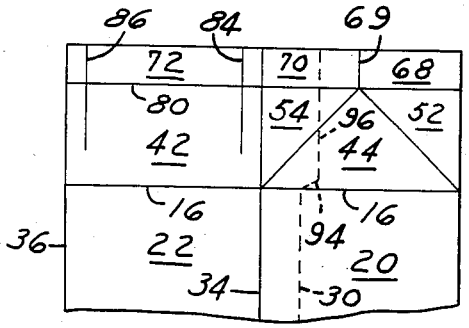
FIG. 2 is a fragmentary layout view of the outside surface of a container structure after it is side seamed from the container blank illustrated in FIG. 1.

The container blank 10 illustrated in FIG. 1 is first formed into a side seam blank as illustrated in FIG. 2. The side seam blank is formed by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned parallel and substantially aligned with the vertical score line 38. The various members of the first end closure 12 and the second end closure (not shown) will make similar movements, and the container will appear as illustrated in FIG. 2. The container blank 10 is then sealed where the inside area of the body panel 18 comes into contact with the outside surface of the side seam flap 26.

Figure 3:
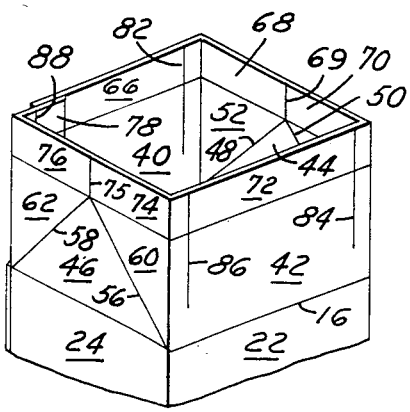
FIG. 3 is a fragmentary perspective view showing the side seamed container blank illustrated in FIG. 2 in an open ended condition prior to the closing of the end closure structure of the present invention.

The next step in forming the side seamed blank into a container is illustrated in FIG. 3. FIG. 3 illustrates how the side seam blank is opened up into a squared condition, after which the second end closure (not shown) is formed and sealed in a manner well known in the container art, and disclosed in detail in the above cited prior art patents.

After the second end closure (not shown) is formed and a product, such as milk or juice, has been inserted in the container, the various parts of the first end closure 12 are folded about the various score lines in the following manner so as to form the closed end structure. The triangular panel 44 is moved around the horizontal score line 16 over the end of the filled container and away from its center. At the same time, the triangular closure panel 46 is likewise moved away from the center of the filled container about the horizontal score line 16. The inside surfaces of the sealing panels 68 and 70 are rotated towards each other about the vertical score line 69, the inside surfaces of the sealing panels 74 and 76 are rotated towards each other about the vertical score line 75, and the inside surfaces of the sealing panels 66 and 72 are moved toward each other. The inside surfaces of the triangular panels 52 and 54 thereby come into contact with the triangular panel 44, and the inside surfaces of the triangular panels 60 and 62 come into contact with the panel 46.

The sealing of the panels 70, 72 and 74 to the panels 68, 66 and 76, respectively, is accomplished by conventional means, such as a sonic or high frequency vibration sealing means, such a seal providing a liquid tight seal. The sealing of these various top end closure elements may also be accomplished by other means, such as gas heat, if desired.

Figure 4:
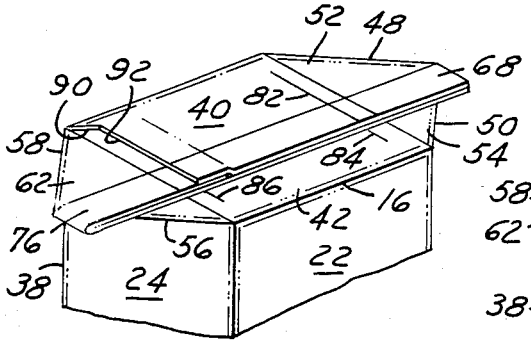
FIGS. 4 and 5 are fragmentary perspective views similar to FIG. 3, and showing the end closure evolved from the blank of FIG. 3 in partially closed conditions.
Figure 5:
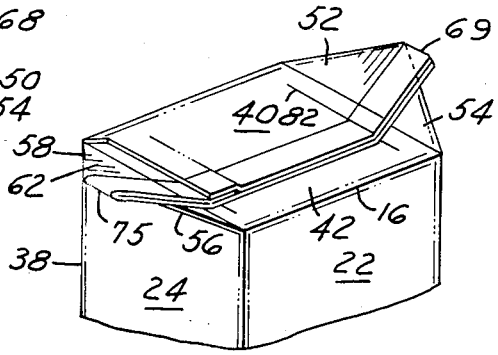

FIG. 4 illustrates the positions of the various elements of the top end closure 12 once the sealing thereof has been effected and the top closure has been moved into a flat configuration with the 44 and 46 groups of panels extending outwardly from the side panels 20 and 24, respectively. As indicated in FIG. 5, the 44/52/55 and 46/60/62 groups of panels are both folded inwardly with a 180° turn about their respective segments of score line 16, into the flat configuration of FIG. 6.

Figure 6:
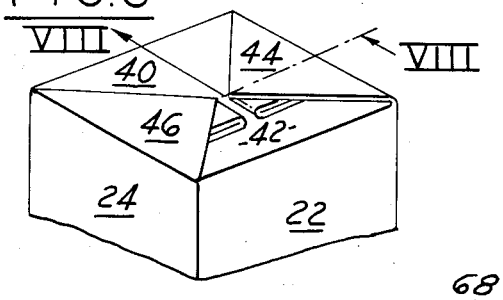
FIG. 6 is a fragmentary perspective view showing the container after the end closure has been folded and sealed into a flat, completely closed condition.
Figure 7:
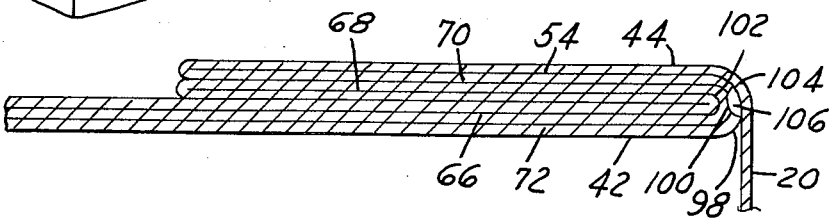
FIG. 7 is a fragmentary cross-sectional view showing a prior art container after being folded through the steps of FIGS. 4, 5 and 6.
Figure 8:
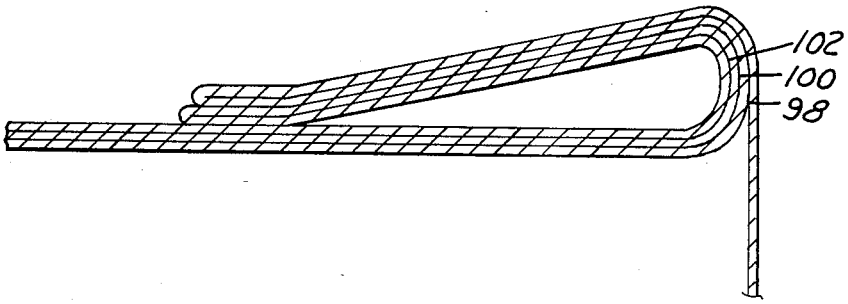
FIG. 8 is a fragmentary cross-sectional view taken along the plane of the line 8—8 of FIG. 6, and looking in the direction of the arrows, showing a container of the present invention after being folded through the steps of FIGS. 4, 5 and 6.

Without the inclusion of the supplemental score lines 82, 84, 86, and 88, the final folded configuration of FIG. 6 would include the seven thicknesses shown in FIG. 7, wherein three layers identified as 98 (including the panels 42 and 54), 100 (including the panels 72 and 70), and 102 (including the panels 66 and 68) each will have been folded 180° and one layer 104 (including the panels 20 and 44) will have been folded 90°. Throughout such folding operations, at times the outermost 180° folded layer 98 is stretched to the point where it becomes pulled apart at the score line 34, resulting in a crack, as shown at 106 in FIG. 7. Now, by including the supplementary score lines 82–88, the severity of the bends for the layers 98, 100 and 102 is reduced from 180° bends to respective pairs of spaced apart substantially 90° bends, as shown in FIG. 8. Specifically, there are panel portions between the various score lines at the corner shown in FIG. 8, i.e. a portion of the panel 42 between the score lines 84 and 34 where the latter separates the panels 54 and 42, a portion of the panel 72 between the score lines 84 and 34 where the latter separates the panels 72 and 70, and a portion of the panel 66 between the score lines 82 and 32 where the latter separates the panels 68 and 66.

Figure 9:
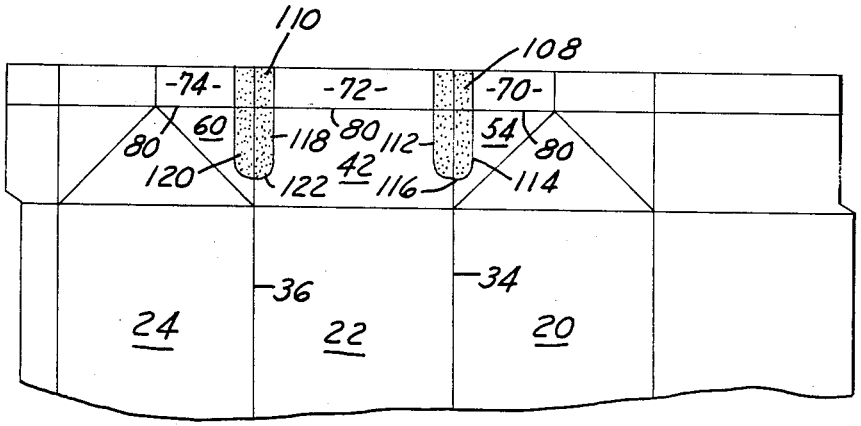
FIGS. 9–13 are comparable to FIGS. 1 and 3–6, showing an alternate embodiment of the invention.

Referring now to FIG. 9, it is noted that embossed areas or wide score lines 108 and 110 are used in lieu of the supplemental score lines 84 and 86 of FIG. 1, and the score lines 82 and 88 of FIG. 1 have been deleted. The embossed area 108 has one edge 112 thereof located at the same general location as the score line 84 of FIG. 1, from which it extends across the score line 34 to its second edge 114, such that the score line 34 defines the center line of the area 108. An arcuate-shaped edge 116 connects the edges 112 and 114 at the inner end thereof.

The embossed area 110 is comparable in size to the area 108, and relates to the score lie 36 as the area 108 relates to the score line 34. Specifically, an edge 118 is located at the same general location as the score line 86 of FIG. 1, from which it extends across the score line 36 to its other edge 120, the two edges being interconnected by an arcuate-shaped edge 122.

Figure 10:
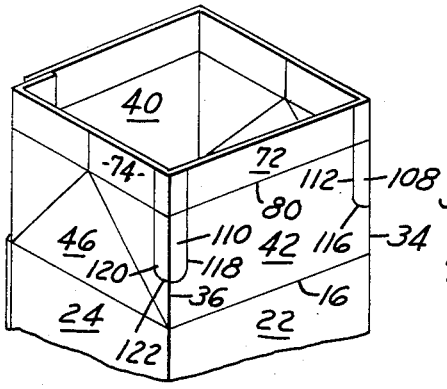
Figure 11:
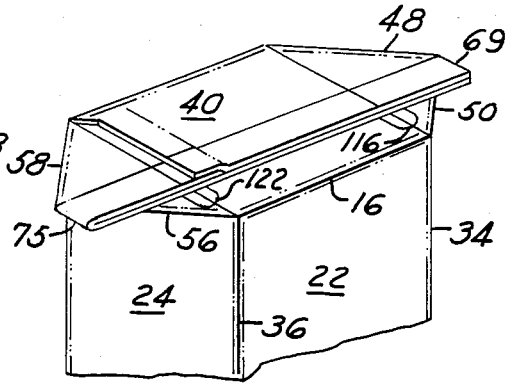
Figure 12:
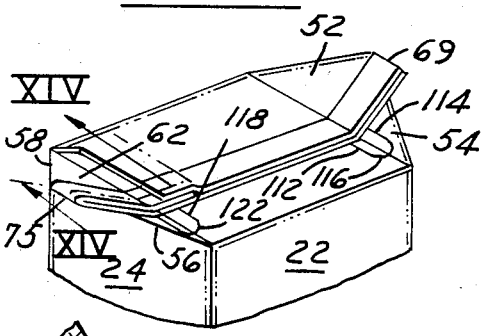
Figure 13:
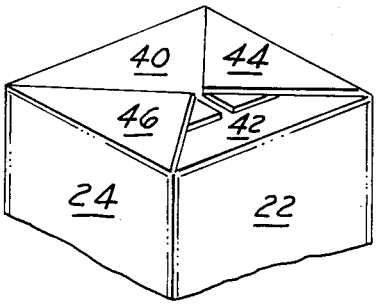

In the folding process, it may be noted in FIGS. 10–12 that the embossed areas 108 and 110 are on the highly stressed portions of the end closure, each adapted to being folded onto itself at opposite sides of the end closure such that one portion thereof overlaps another portion thereof. Specifically, as seen in FIGS. 11 and 12, the areas 108 and 110 are each folded at a mid-portion thereof about the horizontal score line 80.

Figure 14:
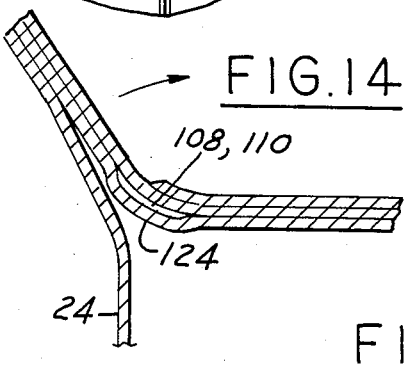
FIG. 14 is an enlarged fragmentary cross-sectional view taken along the plane of the line 14—14 of FIG. 12, and looking in the direction of the arrows.

The specific action which occurs to prevent cracking is illustrated in FIG. 14, where it may be noted that, as a result of the embossments 108 and 110, the material 124 thereunder is distorted toward the inside of the container to effectively provide surplus material for enhancing the folding thereof without cracking.

Figure 15:
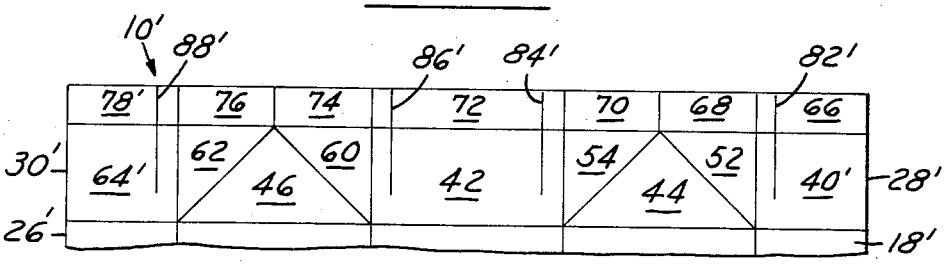
FIG. 15 is a fragmentary layout view of the outside surface of an alternate embodiment of a thermoplastic coated paperboard container blank formed in accordance with the invention.

Referring now to FIG. 15, an alternate blank embodiment 10' is shown, adaptable to being folded into a so-called, center side seam type of end closure. Those elements which differ from the respective elements of FIG. 1 are identified by reference numerals bearing primes; otherwise the elements are the same as those of FIG. 1.

Specifically, rather than a substantially full width panel segment 40 and a narrow side seam extension 64, the blank 10' includes two closure panels 40' and 64' and respective associated sealing panels 66' and 78', terminated by straight edges 28' and 30'. The associated body panels 18' and 26' are the same widths as the respective closure panels 40' and 64'.

While the folding process is the same as for the blank 10, once folded, the free edge 28' will be located at approximately the center of one of the sides of the resultant container, rather than at a corner, as in the case of the free edge 28 overlying the score line 38 shown in FIG. 3. In the folding process, the four sets of supplemental score lines 82, 84, 86, and 88 of the blank 10' function the same as those on the blank 10, resulting in an end closure like that shown in FIG. 8.

INDUSTRIAL APPLICABILITY

It should be apparent that the end closures formed from either the blank 10 or the blank 10' may be used for either a top or a bottom end closure, and that stretching and possible cracking resulting from 180° bends (FIG. 7) is minimized by the conversion of each of the 180° bend into substantially two 90° bends (FIG. 8).

It should also be apparent that, if the end closure of FIG. 8 is used as a bottom end closure, i.e., inverted from the attitude shown, the bottom of the carton would be supported at the four corners thereof in a very stable configuration.

It should be further apparent that the panels may be of widths such that the formed carton may be either rectangular or square in cross-section, and that the embossed feature of FIGS. 9–14 may be used with either the FIG. 1 or the FIG. 15 embodiments.

While but three embodiments have been shown and described applying the supplemental score lines, other modifications thereof are possible within the scope of the following claims.

The embodiments of the invention in which an exclusive property or privilege is claimed are defined as follows:

1. In a blank for constructing a container adaptable to being folded into a flat end container, wherein the blank includes five body portion panels interconnected by longitudinal score lines, five end closure panels connected via a first row of lateral score lines to respective ends of the body portion panels and separated by said longitudinal score lines; said five end closure panels including two panels having triangular panels respectively connected to the ends of two alternate body portion panels, and inner closure panels respectively connected to the ends of the other three alternate body portion panels; a pair of additional triangular panels connected via diagonal score lines to the opposite sides of each of said triangular panels; full width sealing panels respectively connected via a second row of lateral score lines to said inner closure panels; and a pair of sealing panels respectively connected via said second row of lateral score lines to each pair of additional triangular panels; the improvement comprising supplementary score lines formed on the edge portions of the full width sealing panels and inner closure panels located adjacent opposite sides of each pair of aligned additional triangular panels and sealing panels, parallel to said longitudinal score lines.

2. The blank described in claim 1, wherein each of said supplementary score lines includes score lines formed across the height of said full width sealing panels and partially across the height of said inner closure panels adjacent said additional triangular panels.

3. In a flat end container including four body panels interconnected by vertical score lines, one of the body panels being formed by two partially overlapped and sealed panels, four end closure panels connected via a first row of horizontal score lines to respective ends of the body panels and separated by said vertical score lines; said end closure panels including triangular panels respectively connected to the top ends of two alternate body panels, a pair of inner closure panels respectively connected to the top ends of the other two alternate body panels; a pair of additional triangular panels connected via diagonal score lines to the opposite sides of each of said triangular panels; a pair of full width sealing panels respectively connected via a second row of horizontal score lines to said inner closure panels; and a pair of half-width sealing panels respectively connected via said second row of horizontal score lines to the additional triangular panels; the improvement comprising supplementary score lines formed on the edge portions of the full width sealing panels and inner closure panels located adjacent opposite sides of each pair of aligned additional triangular panels and sealing panels, parallel to said vertical score lines.

4. The container described in claim 3, wherein each of said supplementary score lines includes a score line formed across the height of said full width sealing panel and partially across the height of said inner closure panel adjacent each of said additional triangular panels.

5. The container described in claim 4, wherein the container is a thermoplastic coated paperboard container, and said supplementary score lines serve to provide second substantially 90° bends, supplementing substantially 90° bends about said first row of horizontal score lines, in lieu of 180° bends about said first row of horizontal score lines, thereby diminishing the chances for cracking of the thermoplastic coating at the bend locations.

* * * * *